US005458307A

United States Patent [19]

Gebka

[11] Patent Number: 5,458,307

[45] Date of Patent: Oct. 17, 1995

[54] RIBBED PRICE CHANNEL

[75] Inventor: John Gebka, Coral Springs, Fla.

[73] Assignee: FEMC Ltd., Ft. Lauderdale, Fla.

[21] Appl. No.: 180,349

[22] Filed: Jan. 12, 1994

[51] Int. Cl.[6] ..... A47G 1/17

[52] U.S. Cl. ..... 248/205.3; 40/618; 40/642; 248/903

[58] Field of Search ..... 248/205.3, 225.1, 248/220.3, 223.4, 221.4, 220.2, 224.4, 231.9, 903; 40/642, 618, 620; 211/94

[56] References Cited

U.S. PATENT DOCUMENTS

| | | | |
|---|---|---|---|
| 1,877,919 | 9/1932 | Livingston | 40/618 |
| 1,943,168 | 1/1934 | Doppel | 40/618 X |
| 1,943,740 | 1/1934 | Olson | 40/618 |
| 3,174,239 | 3/1965 | Cramer | 40/618 X |
| 4,295,275 | 10/1981 | Cugini, Sr. et al. | 40/621 X |
| 4,693,381 | 9/1987 | Lodge | 248/220.2 X |
| 4,756,498 | 7/1988 | Frye | 248/205.3 |

FOREIGN PATENT DOCUMENTS

| | | | |
|---|---|---|---|
| 0376507 | 7/1932 | United Kingdom | 40/618 |

*Primary Examiner*—Ramon O. Ramirez
*Attorney, Agent, or Firm*—Jacobson, Price, Holman & Stern

[57] ABSTRACT

A ribbed plastic price channel for use on a product display shelf to receive product labels has a high friction coating on the ribs to reduce the tendency for an inserted label to slide along the channel and out of position.

6 Claims, 2 Drawing Sheets

RIBBED PRICE CHANNEL

BACKGROUND OF THE INVENTION

This invention relates to price channels and, more specifically, to plastic price channels of the kind commonly used along the front edge of the merchandise display shelf in a supermarket or other store to receive labels or sign holders conveying information regarding products on the shelf.

Plastic price channels of the above kind commonly have an adhesive backing by which a price channel is attached to a shelf, and a C-shaped profile with upper and lower lips between which a label or sign holder is gripped. Some price channels have longitudinally extending ribs or ridges to facilitate label removal.

Since plastic price channels are generally made as extrusions of somewhat hard polyvinyl chloride (PVC) having a low friction or glossy outer surface, a problem which may arise in use, is that inserted labels can slide and become easily displaced along the channel to positions in which they may no longer be properly positioned relative to the products with which they are intended to be associated. The present invention overcomes this problem, at least to a substantial extent.

SUMMARY OF THE INVENTION

It is an object of the invention to provide an improved plastic price channel of the kind referred to which reduces the ability for attached labels to slide along the channel.

It is another object of the invention to provide a means for increasing the friction coefficient of a plastic price channel to reduce the label sliding problem.

In accordance with the invention, at least in a preferred embodiment, a plastic price channel having longitudinal ribs as aforesaid, is provided with a high-friction coating on the ribs, and preferably only on the ribs, to create a friction surface for an inserted label. By this coating of the ribs, it is found that inserted plastic and like labels have less tendency to slide along the channel than in similar price channels with uncoated ribs or without ribs. Generally, the price channel itself is an extrusion of a somewhat hard PVC and the ribs or a coating on the ribs may be a co-extrusion of a softer PVC. The price channel may be extruded from any conventional PVC referred to commercially as "rigid" such as Occidental Chemical Corporation's OXYCLEAR 161J/161J-1 or Georgia Gulf's Extrusion Compound 8247 or 7020. The rib coating may be co-extruded from a "flexible" PVC such as Teknor Apex Company's 3165 Compound or Synergistics' Clear Compound 0750. Of course, these commercially available PVC extrusion compounds are identified as illustrative. Further, while PVC is the material of choice for both the price channel and the coating, those skilled in the art can readily substitute alternative rigid and flexible polymers therefor without departing from the instant inventive concepts. Moreover, the price channel itself can even be formed of a different material from the coating. For example, the price channel can be metal, with flexible PVC coated ribs provide thereon.

Additional features and advantages of the invention will become apparent from the following description and drawings read in conjunction with the attached claims.

DESCRIPTION OF THE PREFERRED EMBODIMENT

The figures show an extruded price channel 10 of a kind which is generally well known and which preferably has a strip of contact adhesive generally covered by release tape 12 at the back along the top edge for securing the price channel to the front edge of a merchandise display shelf. Of course, a price channel which is integrally formed with a product shelf may be provided with friction-enhanced rib elements in accordance with the instant inventive concepts as well.

The price channel 10 has upper and lower lips 14, 16 between which an inserted label may be gripped, and a plurality of longitudinal ribs or ridges 18 to facilitate label removal. The price channel 10 may, for example, be extruded from a relatively hard or rigid PVC as described or molded in some other fashion. Typically the thickness of a price channel to be adhesively or otherwise secured to the edge of a product shelf is about 0.04 inch, and such products are generally provided in 48 inch sections.

Figures 1, 2, 3:
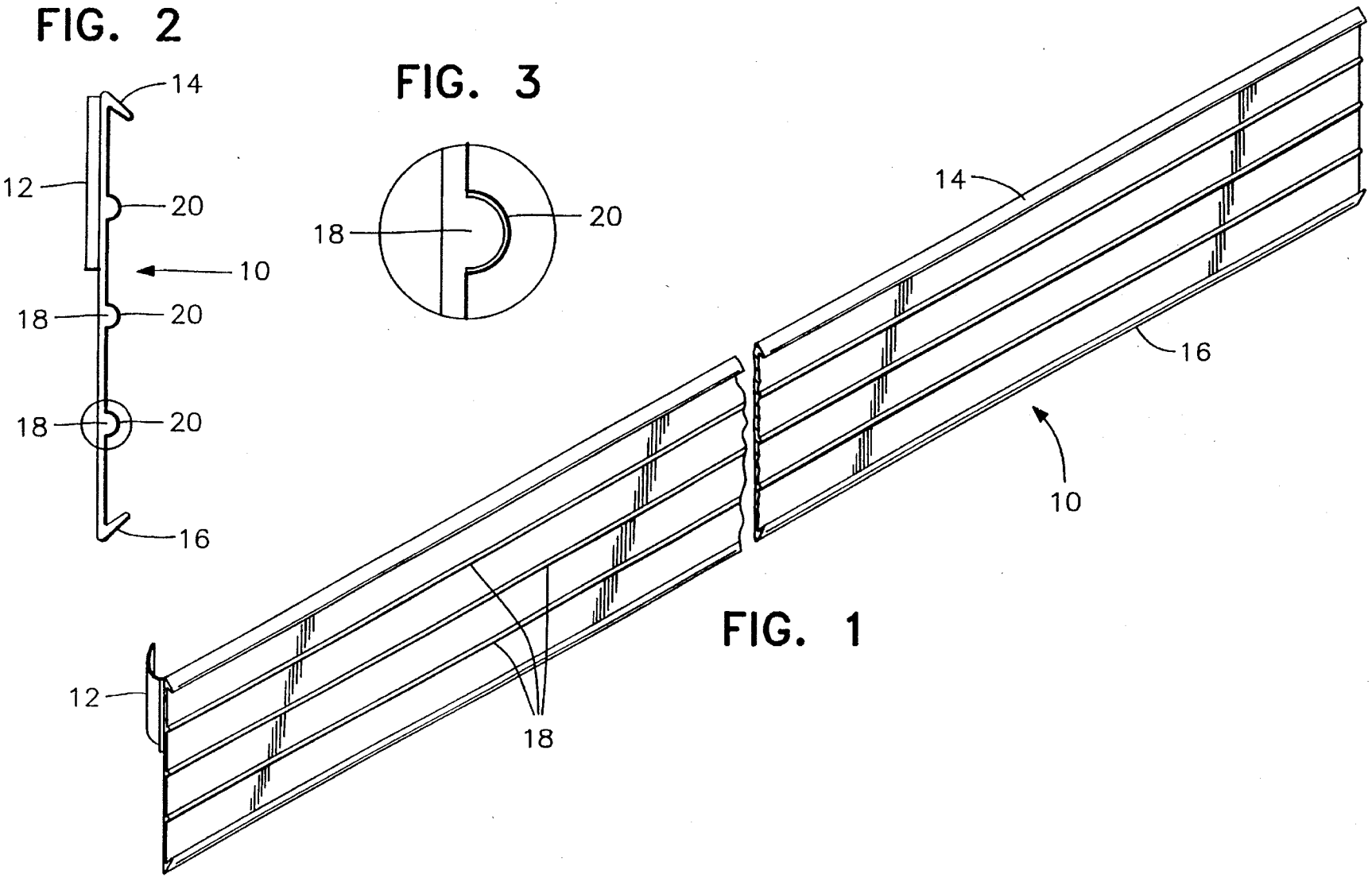
FIG. 1 is a perspective view of a plastic price channel according to the invention.
FIG. 2 is an end view of the price channel.
FIG. 3 is an enlarged view of a part of the price channel shown circled in FIG. 2.

In accordance with the invention, each rib or ridge 18 is coated along its length, e.g., by co-extrusion, with a material 20 (see FIG. 3) such as the aforementioned flexible PVCs, which is softer and tackier than the material of the price channel itself, so as to provide a high-friction surface backing for inserted labels. While various materials and manufacturing techniques have been mentioned herein, the preferred product according to this invention is a co-extruded rigid and flexible PVC price channel.

Figures 4, 5:
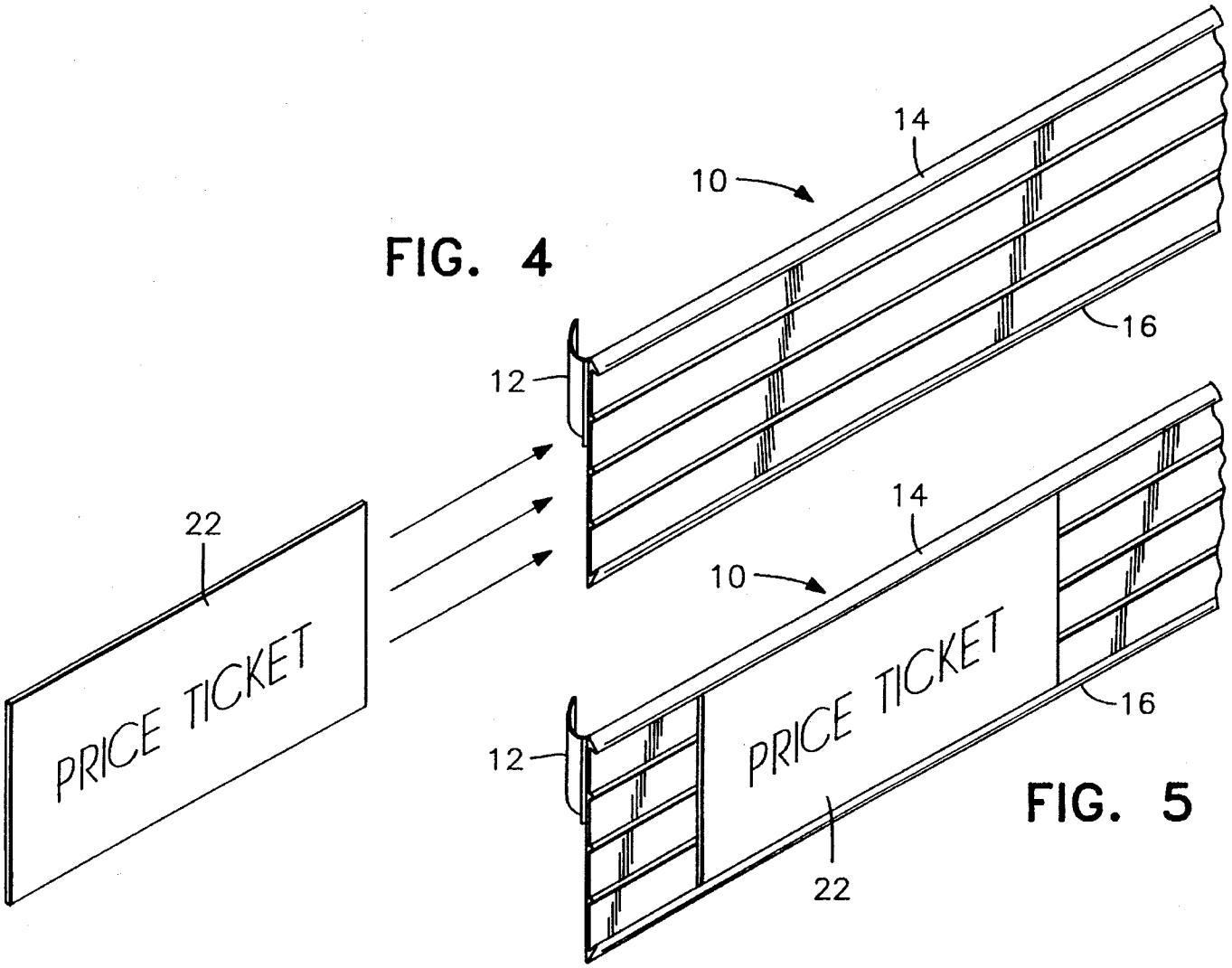
FIG. 4 is a perspective view of the price channel showing a label being inserted.
FIG. 5 is a view similar to FIG. 4 with the label inserted.

In use, a label or price ticket 22 is inserted into the price channel in the usual way seen in FIG. 4, to be held between the price channel lips 14, 16. With the inventive price channel, however, in contrast to channels without coated ribs, the rib coating provides a frictional resistance for the label, reducing its tendency to slide along the channel, without affecting the function of the ribs in facilitating label removal.

While only a preferred embodiment of the invention has been described herein in detail, the invention is not limited thereby and modifications can be made within the scope of the attached claims.

I claim:

1. A price channel comprising an elongated central section, upper and lower lips extending away from said central section to receive therebetween a merchandise label, and a friction-enhancing material on at least part of said central section between said upper and lower lips to resist lengthwise sliding of the label along the price channel, the price channel further including a plurality of rib means extending in spaced longitudinal relationship along said central section between said upper and lower lips wherein said friction-enhancing material is provided only on said rib means.

2. A price channel for use along a front edge of a merchandise display shelf comprising an elongated sheet of plastic material having front and back surfaces, forwardly extending upper and lower lips between which a product label can be held, a plurality of longitudinally extending rib means extending along said front surface in spaced relationship between said upper and lower lips, and a friction coating on said rib means to resist lengthwise sliding of the label along said price channel, wherein said sheet of plastic material comprises a rigid polyvinyl chloride and said coating comprises a flexible polyvinyl chloride wherein only said rib means are coated by said flexible polyvinyl chloride.

3. A price channel of relatively rigid plastic material comprising an elongated central section, upper and lower lips extending away from said central section to receive therebetween a merchandise label and at least a part of an internal surface of the price channel extending longitudinally of the price channel having a coating of plastic material thereon which coating is softer and tackier than the relatively rigid material forming the price channel to resist lengthwise sliding of the label along the price channel wherein said part of the internal surface of the price channel comprises rib means extending along said central section of the price channel and wherein said coating is provided only on said rib means.

4. A price channel comprising an elongated central section, upper and lower lips extending away from said central section to receive therebetween a merchandise label, and a coating of a friction-enhancing material only on spaced parallel longitudinally extending portions of an interior surface of the price channel whereby said coating resists lengthwise sliding of a label along the price channel.

5. A price channel as claimed in claim 4 wherein said portions comprise longitudinally extending ribs on the central section of the price channel.

6. A price channel as claimed in claim 4 wherein the price channel comprises a relatively rigid plastic material and said coating comprises a softer tackier plastic material.

* * * * *